US009991633B2

(12) United States Patent
Robinet

(10) Patent No.: US 9,991,633 B2
(45) Date of Patent: Jun. 5, 2018

(54) ELECTRICAL SOCKET DEVICE INCLUDING AT LEAST ONE LOCKING AND UNLOCKING ELEMENT

(71) Applicants: LEGRAND SNC, Limoges (FR); LEGRAND FRANCE, Limoges (FR)

(72) Inventor: Franck Robinet, Mayenne (FR)

(73) Assignees: LEGRAND SNC, Limoges (FR); LEGRAND FRANCE, Limoges (FR)

( * ) Notice: Subject to any disclaimer, the term of this patent is extended or adjusted under 35 U.S.C. 154(b) by 0 days. days.

(21) Appl. No.: 15/534,819

(22) PCT Filed: Oct. 30, 2015

(86) PCT No.: PCT/FR2015/052928
§ 371 (c)(1),
(2) Date: Jun. 9, 2017

(87) PCT Pub. No.: WO2016/092163
PCT Pub. Date: Jun. 16, 2016

(65) Prior Publication Data

US 2017/0338591 A1 Nov. 23, 2017

(30) Foreign Application Priority Data

Dec. 9, 2014 (FR) ..... 14 62140

(51) Int. Cl.
*H01R 13/627* (2006.01)
*H01R 13/629* (2006.01)

(52) U.S. Cl.
CPC ..... *H01R 13/6275* (2013.01); *H01R 13/629* (2013.01)

(58) Field of Classification Search
CPC ..... H01R 13/629; H01R 13/62933; H01R 13/6275; H01R 13/639; H01R 13/6395; H01R 13/6272; H01R 24/40
(Continued)

(56) References Cited

U.S. PATENT DOCUMENTS 9,553,407 B2 * 1/2017 McDowall ..... H01R 13/6275
9,735,502 B2 * 8/2017 Stevens ..... H01R 13/621
(Continued)

FOREIGN PATENT DOCUMENTS

EP 0452061 A1 10/1991
EP 1667286 A2 6/2006
EP 2639895 A1 9/2013

OTHER PUBLICATIONS

International Search Report for PCT/FR2015/052928 (dated Dec. 16, 2015) with partial English language translation.
Written Opinion for PCT/FR2015/052928 (dated Dec. 16, 2015).

*Primary Examiner* — Xuong Chung Trans
(74) *Attorney, Agent, or Firm* — Kenealy Vaidya LLP

(57) ABSTRACT

Some embodiments relate generally to the field of electrical installations. In particular, some embodiments relate to an electrical socket device including at least one mechanism for locking and unlocking a corresponding electrical plug. More precisely, some embodiments relate to the electrical sockets and plugs of couplers, such as those defined by International Standard IEC 60320, for example of type C13 and type C19. These (coupler) sockets and plugs are applied or used in particular in a building that has a network, for example of LAN (Local Area Network) type, or in a data center, where several items of electrically powered equipment are installed.

9 Claims, 4 Drawing Sheets

(58) Field of Classification Search
USPC ..... 439/346, 352, 372
See application file for complete search history.

(56) References Cited

U.S. PATENT DOCUMENTS

| | | | |
|---|---|---|---|
| 2013/0109213 | A1 | 5/2013 | Chang |
| 2013/0162122 | A1 | 6/2013 | Li |

* cited by examiner

ELECTRICAL SOCKET DEVICE INCLUDING AT LEAST ONE LOCKING AND UNLOCKING ELEMENT

CROSS REFERENCE TO RELATED APPLICATION

This application is a National Phase filing under 35 C.F.R. § 371 of and claims priority to PCT Patent Application No.: PCT/FR2015/052928, filed on Oct. 30, 2015, which claims the priority benefit under 35 U.S.C. § 119 of French Application No.: 1462140, filed on Dec. 9, 2014, the contents of which are hereby incorporated in their entireties by reference.

BACKGROUND

Some embodiments relate generally to the field of electrical installations. In particular, some embodiments relate to an electrical socket device including at least one mechanism for locking and unlocking a corresponding electrical plug. More precisely, some embodiments relate to the electrical sockets and plugs of couplers, such as those defined by International Standard IEC 60320, for example of type C13 and type C19. These (coupler) sockets and plugs are applied or used in particular in a building that has a network, for example of LAN (Local Area Network) type, or in a data center, where several items of electrically powered equipment are installed.

Such items of electrical equipment store, form the link between servers storing information, or process information that may be important or even sensitive for the businesses using this type of equipment. It is thus of paramount importance for the electrical coupling between the electrical plug of these items of equipment and the electrical socket to be permanent, particularly when they are active.

Various electrical socket devices that comprise at least one locking and unlocking mechanism, the purpose of which is to retain a corresponding electrical plug, are in existence. One example of an electrical socket device of this type is known from document US 2010/0255708. The device described in this document includes a receptacle provided with at least one electrical socket designed to receive an electrical plug provided with conducting pins. The receptacle defines at least one inner cavity and is provided on one of the surfaces thereof with at least one through hole leading into the inner cavity and with a plurality of holes for receiving the pins of the electrical plug. The device also includes a mechanism for locking and unlocking the electrical plug placed in the cavity in position. This locking and unlocking mechanism includes a flexible part, a section of which is placed opposite a hole of the electrical socket and designed to abut against the conducting pin once the latter is engaged in the hole such as to immobilize it. Furthermore, the locking and unlocking mechanism includes a push member mounted so as to be movable in translation on the mount through the through hole. When the push member is actuated, it exerts a pressure on the flexible part such as to distance the flexible part and thus to unlock the electrical plug.

One of the problems connected with this electrical socket device is that locking is achieved by tightening the pin of the electrical plug via the flexible part. According to this configuration, the locking and unlocking mechanism has to be adapted to the conducting pin of the electrical plug in order for them to engage, the size of the slot of the locking and unlocking mechanism having to be adapted to that of the pin.

Moreover, the flexible part comes into contact with an active pin, and therefore special insulation and heating resistance measures have to be taken.

Similarly, an electrical socket device of the same type is known from document US 2013/0109213. The receptacle of this device includes on one of the surfaces thereof at least one through hole leading into an inner cavity defined by the receptacle and a groove extending circumferentially relative to the electrical socket. The groove is designed to receive a peripheral flange of the electrical plug. This device further includes a mechanism for locking and unlocking the electrical plug placed in the cavity in position and comprising a flexible part provided with a section pivoting relative to a fixed section of this part. The pivoting section includes a slot placed opposite a hole of the electrical socket, the slot being designed to engage with a pin of the electrical plug when the latter is connected to the socket. The pivoting section is configured such that it is always oriented toward the face provided with the hole and such that it exerts a constraint on the pin once engaged in order that the latter can be held. A push member likewise makes it possible to distance the pivoting section of the pin via supplementary elements of the mechanism for unlocking the electrical plug.

However, locking is also achieved by the tightening of the pin of the electrical plug via the pivoting section of the flexible part and by means of friction. The locking and unlocking mechanism also has to be adapted to a certain type of electrical plug or, conversely, to allow the locking and unlocking of the plug. This also requires significant modifications to be made to existing electrical sockets and thus a cost in terms of manufacture. Furthermore, the flexible part is in contact with the ground pin, which is thus urged mechanically, which introduces a supplementary risk for a safety member.

Document US 2013/244468 likewise describes an electrical socket device of the same type, comprising a receptacle having on one of the surfaces thereof at least one through hole leading into an inner cavity defined by the receptacle and a groove extending circumferentially with regard to the electrical socket in order to receive a peripheral flange of the electrical plug. This device also includes a mechanism for locking and unlocking the electrical plug in position arranged in the cavity and comprising a spring interacting with a perforated rectangular plate that by means of friction immobilizes the peripheral flange then received in the groove. An unlocking member likewise makes it possible to distance the perforated plate from the peripheral flange in order to unlock the electrical plug.

SUMMARY

However, just as in the case of the devices described above, this device is difficult to adapt to existing sockets because it is composed of diverse parts that are, in particular, large and separate from one another and which play a role in the environment of the other parts that make up the electrical socket. Furthermore, the perforated plate locks, by means of friction on an inclined edge, a long peripheral flange contact zone, which gives rise to a risk of wear of the peripheral flange and of the plate.

The electrical socket device of some embodiments addresses all or some of the prior art drawbacks and in particular makes it possible to provide a universal solution, i.e. a solution that can be adapted to all existing types of electrical plug and one which is at the same time simple, reliable and compact.

SUMMARY

Some embodiments are directed to an electrical socket device including:

a receptacle provided with at least one electrical socket intended to receive a connection portion of an electrical plug, the receptacle defining at least one inner cavity and having on one of the surfaces thereof at least one through hole leading into the inner cavity and at least one groove extending circumferentially with regard to the electrical socket and comprising an opening leading into the inner cavity, the groove being intended to receive a peripheral flange of the electrical plug;

at least one mechanism for locking and unlocking the electrical plug in position, the locking and unlocking mechanism comprising:

a mount arranged in the inner cavity of the receptacle;

a flexible part mounted on the mount, said flexible part comprising an end portion extending through the opening, the end portion being provided, at the free end thereof, with a member for immobilizing the electrical plug in translation, the immobilizing member extending into the groove and being capable of retracting and of retaining, by means of bracing, the peripheral flange of the electrical plug when the peripheral flange is received in the groove;

a push member mounted on the mount and extending through the through hole, the push member comprising an actuation member arranged in the inner cavity opposite the end portion of the flexible part, the push member being mounted so as to be movable in translation relative to the mount along an axis between a first position of rest, in which the actuation member is distant from the immobilizing member of the end portion extending into the groove, retaining the peripheral flange of the electrical plug when the peripheral flange is received in the groove, and a second position of abutment on the push member, in which the actuation member bears on the end portion of the flexible part which is retracted into the inner cavity of the receptacle so as to distance the member for immobilizing the electrical plug in order to release the electrical plug.

Thus, this solution makes it possible to address the above issues, and/or achieve the above advantages. In particular, the electrical socket device according to some embodiments makes it possible to retain or to lock, simply and effectively, the peripheral flange of an electrical plug. A configuration of this type also makes it possible for the electrical socket device to be adapted to and to receive all those types of electrical plug that are provided with a peripheral flange. Added to this is the fact that the proposed locking and unlocking mechanism is compact, intuitive, reliable and simple, since it is formed from a subassembly that is independent of the assembly and of the functioning of the other parts constituting the electrical socket, is designed to be housed in a cavity formed in the receptacle of the electrical socket device, and since a single action on the part of the user allows locking or unlocking of the electrical plug from the electrical socket.

According to a feature of some embodiments, the flexible part may be configured such that, in the second position of abutment on the push member, the end portion exerts an elastic urging force on the actuation member of the push member, toward the first position of rest of the push member, giving rise to a longitudinal displacement of the push member from the second position toward the first position when the electrical plug is disengaged from the electrical socket and the groove.

A configuration of this type enables the device to be operational for the subsequent coupling of an electrical plug in the electrical socket, all by means of a simple gesture on the part of the user.

According to one embodiment of the invention, the flexible part is a metal blade comprising a first branch extending into the inner cavity, a second branch forming the end portion, and an elbowed portion connecting the first branch to the second branch.

According to a further embodiment of the invention, the mount is formed from two complementary half-shells defining an internal housing, the housing leading to a window, and the first branch and the elbowed portion are arranged in the housing of the mount, the second branch extending outside the mount, through the window.

This configuration of the mount facilitates the assembly of the flexible part and the satisfactory management of the positioning and abutment points thereof.

According to a further embodiment of the invention, the mount is formed from a monobloc part comprising a stud, and the first branch is provided with an aperture capable of receiving the stud for the clipping of the flexible blade on the mount, the flexible blade being clipped on the mount at the level of the elbowed portion.

A configuration of this type is particularly economical in terms of production and stock management owing to the reduced number of components.

According to a further advantageous, but optional, feature of the invention, the mount is provided on an external face with at least one reinforcement, and the push member includes at least one tab capable of interacting with one or more of the reinforcement(s) of the mount.

Thus, the push member is clipped on the mount such that it is always held on the mount while promoting the displacement of the push member relative to the mount.

According to yet a further feature of the invention, the mount forms a post, the end portion of the flexible part extending forward of the post, toward the electrical socket, and the push member is formed from a monobloc tube capable of being engaged on the post.

This arrangement promotes the guiding of the push member in the mount and increases the autonomy and the reliability of functioning of the subassembly constituted.

According to yet a further feature of the invention, the monobloc tube includes a forward-projecting section, said section forming the actuation member, and the monobloc tube further includes a chamber provided with an opening leading under the forward-projecting section, the end portion of the flexible part extending through the opening.

According to yet a further feature of the invention, the mount and/or the push member is constituted from a plastics material, which makes it possible to facilitate manufacture and to provide a mechanism at a lower cost.

According to a further embodiment of the invention, the receptacle is provided with a plurality of electrical sockets, each electrical socket being designed to receive a coupling portion of an electrical plug, and the electrical socket device includes a plurality of locking and unlocking elements, each locking and unlocking element being capable of locking and unlocking an electrical plug received in one of the electrical sockets.

A configuration of this type allows the electrical coupling of several electrical equipment items to one and the same electrical socket device, thereby reducing the overall space required.

BRIEF DESCRIPTION OF THE FIGURES

Further innovative features and advantages of the invention will emerge from a reading of the following description that is given by way of indication and is in no way limiting, with reference to the appended drawings, in which.

For greater clarity, identical or similar elements are referenced by identical reference signs throughout the figures.

DETAILED DESCRIPTION OF THE EMBODIMENTS

Figure 1:
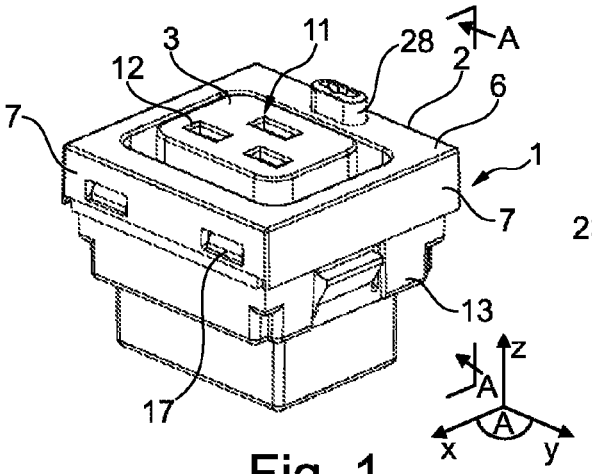
FIG. 1 is a perspective illustration of an example of an electrical socket device according to the invention.
Figure 2:
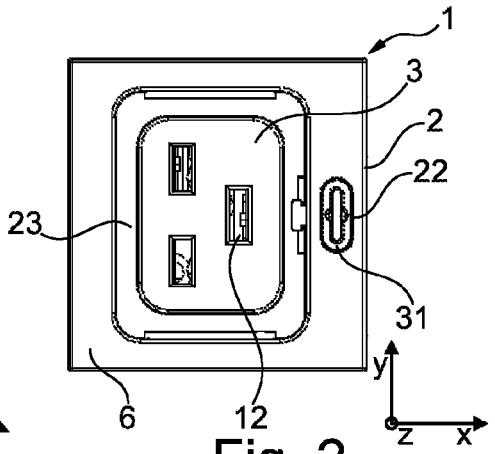
FIG. 2 is a top view of an example of an electrical socket device according to the invention.

FIGS. 1 and 2 represent, respectively in perspective and in expanded view, an electrical socket device 1 according to one embodiment of the invention. This electrical socket device 1 is designed to equip an electrical installation case that can be secured in a cabinet or electrical box or on a wall of a building or of a data center or, alternatively, can form part of a movable extension unit, for example.

More precisely, this electrical socket device 1 includes a receptacle 2 provided with at least one electrical socket 3 designed to receive an electrical plug 4 (cf. FIGS. 10 to 13) of an item of electrical equipment in order that same is connected to the mains electricity. To that end, the electrical plug 4 includes electrical connection means generally constituted by at least one conducting pin (not shown) and a peripheral flange 5 providing protection for the conducting pin. The electrical socket 3 includes holes 12 for the passage of the conducting pin of the electrical plug 4.

Figure 3:
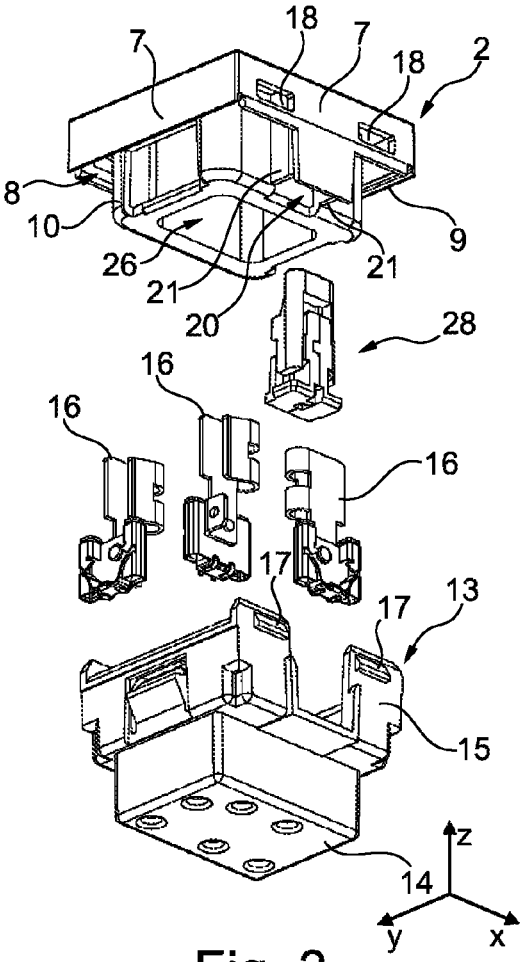
FIG. 3 is an expanded, perspective view of an example of an electrical socket device according to the invention.
Figure 4:
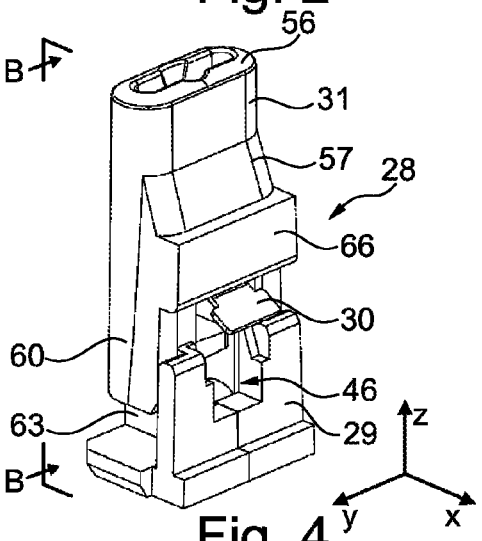
FIG. 4 is a perspective illustration of an example of a mechanism for locking and unlocking an electrical plug in position according to the invention.

To facilitate understanding of the invention with reference to the illustrated figures, and in particular FIGS. 1, 2, and 3, the receptacle 2 is considered to extend along a vertical longitudinal axis Z, the height of the receptacle being defined along the axis Z. Also shown is the horizontal axis X, which is perpendicular to the vertical longitudinal axis Z and to a transverse axis Y such that these three axes X, Y, Z form a direct orthogonal reference system. The terms "lower" and "upper" are defined relative to the vertical axis Z, the term "lateral" is defined relative to the transverse axis X, and the terms "forward" and "rear" are defined relative to the transverse axis Y.

The receptacle 2 generally includes a base 6 extending in a plane A (formed, in FIG. 1, by the axes X and Y). Lateral walls 7 extend from the base 6 in a direction perpendicular to the base 2 and an opening 8 opposite the base 6 is delimited by a peripheral border 9 of the lateral walls 7. The receptacle 2, in particular the base 6, includes a surface 19 oriented toward the electrical plug 4 when this is connected to the electrical socket 3, and an opposite surface 19' (cf. FIG. 8) oriented toward the opening 8. At least one through hole 22 provided in the base 6 traverses the surfaces 19, 19' from one side to the other and leads into the opening 8. Also provided in the base 6 is at least one groove 23 extending circumferentially with regard to the electrical socket 3, the groove 23 being designed to receive the peripheral flange 5 of the electrical plug 4. The through hole 22, the holes 12 of the electrical socket 3 and the groove 23 are distinct from one another.

Figure 8:
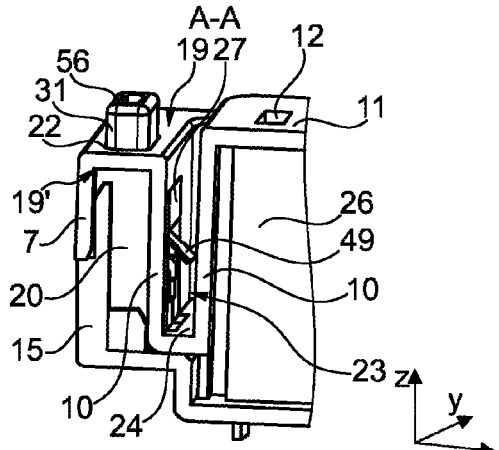
FIG. 8 is a sectional view on A-A, and in perspective, of an example of a receptacle of the locking and unlocking device according to FIG. 1.
Figure 9:
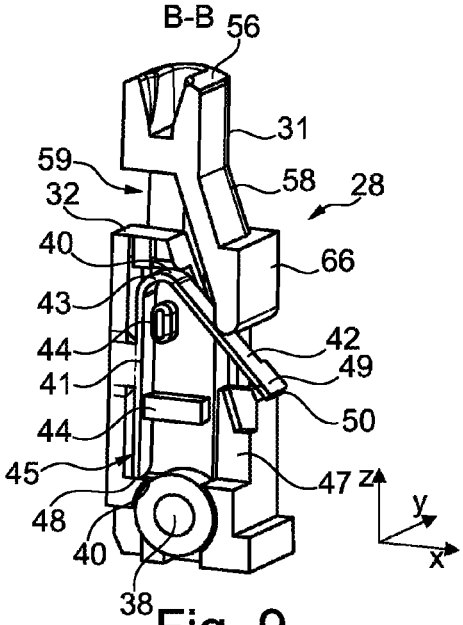
FIG. 9 is a sectional view on B-B, and in perspective, of the locking and unlocking mechanism of FIG. 4.

More precisely, and as illustrated in FIG. 8, the groove 23 includes a bottom 24 connected to opposite lateral walls 10 extending in a direction parallel to the axis Z. The lateral walls 10 of the groove 23 are also connected, respectively, to the base 6 and to the electrical socket 3. This latter, provided in the receptacle 2, includes an upper wall 11 defined in a plane substantially parallel to the plane of the base 6. The upper wall 11 includes the holes 12 for the passage of the one or more pins.

With reference to FIG. 3, a fixed connector 13 forming part of the electrical socket device 1 allows the receptacle 2 to be received so as to form a case. The fixed connector 13 generally includes a bottom 14 and planar parts 15 rising from the bottom 14 and open at the end opposite the bottom 14. The bottom 14 of the fixed connector 13 is provided with holes designed to receive electrical cabling (not shown). The fixed connector 13 is designed to receive metal couplers 16 that are connected to the electrical cabling via coupling terminals formed in the lower portion thereof and which, via cells formed in the upper portion thereof, receive the conducting pins of the electrical plug 4. These electrical couplers are accommodated in a chamber 26 formed by one of the lateral walls 10 of the groove 23. The receptacle 2 set into the fixed connector 13 is held and retained therein by means of complementary retention elements. To that end, the lateral planar parts 15 of the fixed connector 13 are provided with studs 17 designed to interact with apertures 18 of the lateral walls 7 of the receptacle 2.

The receptacle 2 defines an inner cavity 20 located between one of the lateral walls 10 of the groove 23 and a lateral wall 7 of the base 6. The inner cavity 20 is thus distinct from the groove 23. In other words, as may be seen in FIG. 8, the inner cavity 20 is separated from the electrical socket 3 by the groove 23. The inner cavity 20 is open in the lower portion of the receptacle 2, as shown in FIG. 3. More precisely, when the receptacle 2 and the fixed connector 13 are assembled, the inner cavity 20 is closed and includes six sides, four of which are formed by a lateral wall 10 of the groove 23, a lateral wall 7 of the receptacle 2 opposite that of the groove 23, the base 6, and the bottom 14 of the fixed connector 13 thus opposite the base 6. The two other remaining sides 21 are opposite and each connect the lateral wall 7 of the receptacle 2 to the lateral wall of the groove.

The through hole 22 preferably leads into the inner cavity 20 defined in the receptacle 2. Furthermore, as illustrated in FIG. 8, the groove 23 includes an opening 27 likewise leading into the inner cavity 20 and, in particular, made in the lateral wall 10 of the groove 23 separating the inner cavity 20 from the groove 23. In other words, the through hole 22 and the opening 27 are in communication with one another. The through hole 22, the opening 27 and the inner cavity 20 are distinct from one another.

The electrical socket device 1 also includes a mechanism 28 for locking and unlocking the electrical plug 4 in position, said plug being accommodated at least in part in the inner cavity 20 of the receptacle 2. With reference to FIGS. 4 to 6, 9 and 14, the locking and unlocking mechanism 28 includes a mount 29, a flexible part 30 and a push member 31, which are described below.

Figure 5:
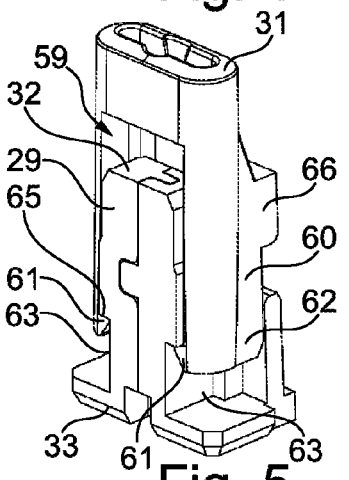
FIG. 5 illustrates, in accordance with another perspective, the locking and unlocking mechanism of FIG. 4.
Figure 6:
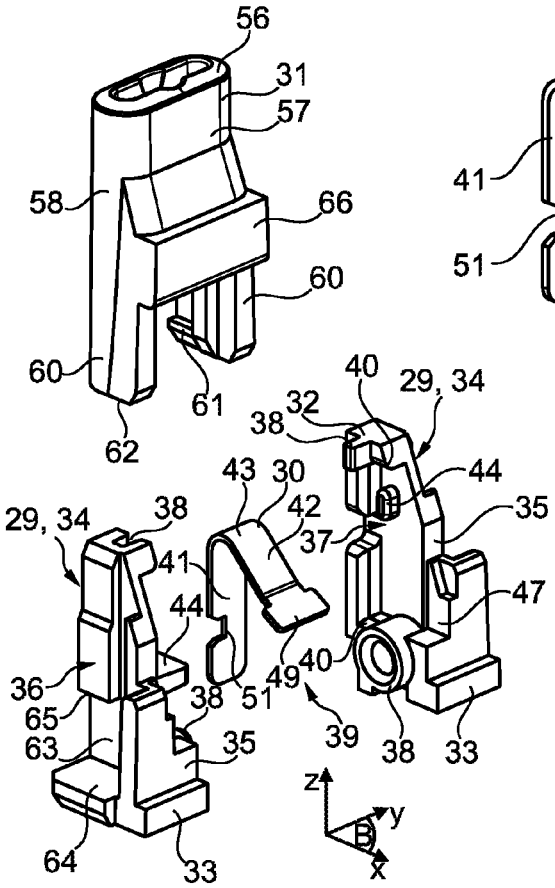
FIG. 6 represents an expanded view of the locking and unlocking mechanism of FIG. 4.

The mount 29 of the locking and unlocking mechanism 28 is received in the inner cavity 20 of the receptacle 2 and is elongate in a direction parallel to the axis Z, with reference to FIGS. 5 and 6, between a head 32 and a foot 33 of the mount 29. According to one embodiment of the mount illustrated in FIGS. 4 to 6 and 9, said mount is formed by two complementary half-shells 34 of substantially identical shape and which form a post. Each half-shell 34 includes a partition 35 provided with an external face 36 and an internal face 37. An internal edge 47 connects the internal 37 and external 36 faces of each half-shell 34 and delimits the periphery of the partition 35. The internal faces 37 comprise complementary securing elements 38 in order that the half-shells 34 engage easily one in the other. Advantageously, but optionally, the complementary securing elements 38 are members of the male/female type and are forcibly engaged for quick mounting.

The flexible part 30 is also arranged in the inner cavity, in particular it is mounted on the mount 29. According to the embodiment of the invention illustrated in FIGS. 4 to 6 and 9, the flexible part 30 is provided between the two half-shells 34 of the mount 29. To that end, the assembly of the two half-shells 34 forms an internal housing 39 defined by the internal faces 37 of the half-shells 34. At least one of the half-shells 34 includes on the internal face 37 two bearing surfaces 40 that are opposite in the direction parallel to the axis Z (i.e. between the head 32 and the foot 33) and which rise from the partition in a plane B substantially perpendicular to the direction in which the half-shell 34 extends. At least a portion of the flexible part 30 bears between these bearing surfaces 40 and is held inside the mount 29 and at least a portion of the flexible part extends outside the mount 29.

In FIGS. 6 and 7, the flexible part 29 has a section substantially in the form of a V. In particular, the flexible part 29 includes a first branch 41 extending in the inner cavity 20, a second branch 42, and an elbowed portion 43 connecting the first branch 41 to the second branch 42.

Thus, according to this embodiment, the free end 48 of the first branch 41 bears on the bearing surface 40 located toward the foot 33 of the mount 29, while the elbowed portion 43 bears on the bearing surface 40 located toward the head 32 of the mount 29. Moreover, each of the half-shells 34 likewise includes on the internal surface 37 thereof an abutment 44 that makes it possible to retain the first branch 41 of the flexible part 30 in the inner cavity 20 (when the half-shells 34 are assembled) between an internal rear surface 45 of the mount 29 and the abutments 44. More precisely, the first 41 and second 42 branches are mounted on either side of one of the abutments 44. The other abutment 44 is formed by a shoulder of the internal face 37 of a half-shell 34 and has a shape that complements that of a notch 51 made in the first branch 41.

According to a feature of the invention, the second branch 42 of the flexible part 30 forms an end portion extending through a window 46 leading into the internal housing 37 formed in the mount 29. The window 46 is made between the head 32 and the foot 33 of the mount 29 and has a closed perimeter delimited, here, by the internal edges 47 which themselves delimit the internal and external faces of the partitions of the half-shells 34. The fact that the first branch 41 is held immobilized between the internal rear surface 45 and the abutments 44 configures the end portion such that the latter, formed by the second branch 42, is movable between a first "non-urged" position in which it is outside the internal housing 39 and thus the window 46, forward of the mount, and a second "retracted" position in which, through the action of the push member 31, it is retracted into the internal housing 39 of the mount 29.

Advantageously, when the end portion of the flexible part 30 occupies the inactive first position, it extends likewise through the opening 27 leading into the groove 23. In other words, the end portion 42 of the flexible part 30 is located inside the groove 23. The end portion 42 likewise includes an immobilizing member 49 located at its free end 50 and configured so as to lock and to retain, by bracing, the peripheral flange 5 of the electrical plug 4 in the groove 23 of the receptacle 2 when the peripheral flange is received in the groove 23. Different variants of an immobilizing member 49 of the end portion 42, illustrated in FIGS. 7*a* to 7*d*, allow effective, durable locking of the peripheral flange 5 without damage being caused thereto.

Figure 7A:
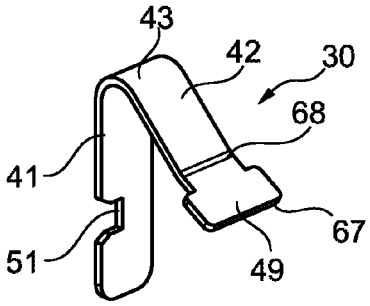
FIGS. 7*a*, 7*b*, 7*c*, and 7*d* illustrate embodiments of a flexible part forming part of the locking and unlocking mechanism according to the invention.
Figure 7B:
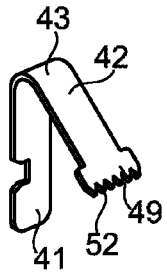
Figure 7C:
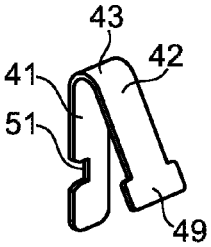
Figure 7D:
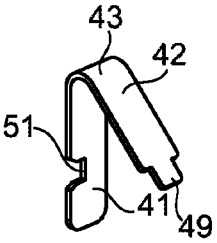

The immobilizing member 49 illustrated in FIGS. 7*a* to 7*c* includes a section in the form of a "T", where the head of the "T" includes a flat edge 67 (FIGS. 7*a* and 7*c*) or teeth 52 (FIG. 7*b*) for improving the locking or anchoring of the immobilizing member in the peripheral flange 5. The immobilizing member may, further, have a tongue form, as shown in FIG. 7*d*. It is likewise possible to make provision for a curved section 68 between the immobilizing member 49 and the end portion 42 in order, also, to improve the locking and the anchoring of the immobilizing member 49, which will be further oriented toward the peripheral flange 5.

The flexible part is preferably a metal blade.

Figure 14A:
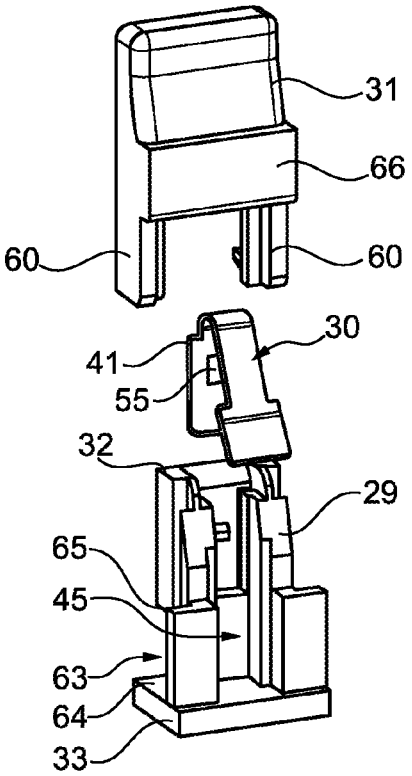
FIGS. 14*a* and 14*b* illustrate an embodiment of the mechanism for locking and unlocking the electrical plug in position.
Figure 14B:
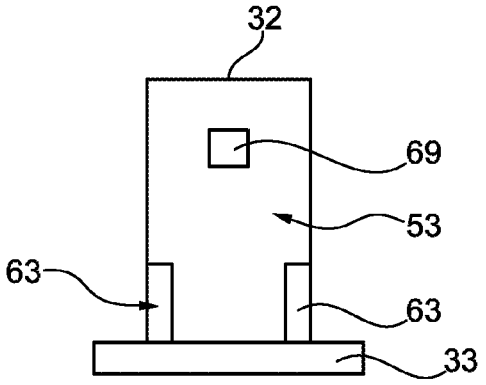

A further embodiment of the mount 29 is illustrated in FIGS. 14*a* and 14*b*. The mount 29 differs from the preceding embodiment illustrated in FIGS. 4, 5, and 6 in that it is formed from a monobloc part, i.e. as a single piece. This mount 29 also has the form of a post and differs furthermore in that it includes on an external rear surface 53 opposite the internal rear surface 45 a stud 69 designed to interact with an aperture 55 made in the first branch 41 of the flexible part 30. In this embodiment, the flexible part 30 is mounted on the mount 29 such that the elbowed portion 43 straddles the head 32 of the mount. The aperture 55 is then capable of receiving the stud 69 for the clipping of the flexible part 30, in this case the flexible blade, on the mount 29 and for the immobilizing of the first branch 41 on the mount 29.

The push member 31 is accommodated partially in the inner cavity 20 and also extends through the through hole 22. It includes a body that is elongate in a direction parallel to the axis Z, with reference to FIGS. 7 and 9. Here, the body is in the form of a monobloc tube with an upper edge 56, a forward wall 57 and a lateral wall 58 that interact in such a manner as to form an internal chamber 59 that is open in the lower portion of the push member 31. The chamber 59 is designed to receive the mount 29 of the locking and unlocking mechanism, i.e. the upper edge 56, the forward wall 57 and the lateral wall cover the head 32 and at least a portion of the partitions 35 of the mount 29 when the push member 31 is mounted on the mount 29. The upper edge 56 is accessible by a user from the surface 19 of the receptacle 2.

The push member 31 is mounted in longitudinal translation relative to the mount 29 on the axis Z between a first position of rest and a second position of abutment, described below. The push member 31 includes two legs 60 extending, respectively, from each lateral wall 58 and comprising at the free end 62 thereof a tab 61. When the push member 31 is moved in translation relative to the mount 29 and in a direction parallel to the axis Z, the tab 61 slides along a reinforcement 63 made on the external face 36 of the mount 29 and between an abutment surface 64 formed by the foot 33 of the mount 29 and a shoulder 65 formed by the reinforcement 63 (cf. FIG. 5). Thus, the push member 31 is clipped on the mount and disengagement thereof from the mount 29 is prevented.

The push member 31 also includes a section projecting toward the front of the push member, which is arranged at the free end of the forward wall 57 of the push member 31, the opening of the chamber 59 leading under the projecting section. This projecting section forms an actuation member 66 and, when the push member 31 is mounted on the mount 29, is arranged opposite the end portion 42 of the flexible part 30 which extends outside the window 46 of the mount 29. More precisely, the actuation member 66 is accommodated and displaced in the inner cavity 20. When the push member 31 is displaced in longitudinal translation, the actuation member 66 undergoes an identical displacement.

According to one configuration of the push member 31, it is mounted so as to be movable in longitudinal translation (in a direction parallel, here, to the axis Z) relative to the mount 29, between:

- the first position of rest, in which the actuation member 66 is distant from the end portion 42 and the immobilizing member 49 extends into the groove 23, thus retaining the peripheral flange 5 of the electrical plug 4 when the peripheral flange 5 is received in the groove; and
- the second position of abutment on the push member 31, in which the actuation member 66 bears on the end portion 42 of the flexible part 30 such as to distance the immobilizing member 49 from the electrical plug 4 and to displace the immobilizing member 49 from the groove 23 toward the inner cavity 20, in order to release the peripheral flange 5 and thus the electrical plug 4.

According to one configuration of the invention, when the push member 29 is displaced in longitudinal translation between the first position of rest and the second position of abutment, the end portion 42 and the immobilizing member 49 retract, moving substantially through a rotation about an axis parallel to the axis X and located toward the elbowed portion 43 of the flexible part. Similarly, when the push member 31 is in the second position, the flexible part 30, in this case the metal blade, is configured such that the end portion 42 exerts an elastic urging force on the actuation member 66 of the push member 31, toward the first position of rest of the push member 31, thereby giving rise to a longitudinal displacement of the push member 31 from the second position of abutment toward the first position of rest when the electrical plug 4 is disengaged from the electrical socket 3 and the groove 23.

Thus, when the push member 31 occupies its first position, the end portion 42 is in the inactive first position, and when the push member 31 occupies its second position of abutment, the end portion 42 is in its retracted second position.

FIGS. 10 to 13 more precisely illustrate, in accordance with a partial sectional view BB, the different positions of the electrical plug 4 in the electrical socket and consequently the first position of rest of the push member 31 and the second position of abutment of the push member 31. More precisely, and with reference to FIG. 10, an electrical plug 4 is shown that has a peripheral flange 5 aligned with the receptacle 2 and opposite the electrical socket 3. FIGS. 11*a* and 11*b* show the electrical plug 4 and the electrical socket 3 assembled together with the peripheral flange engaging in the groove 23 of the receptacle 2. In FIGS. 11*a*, 11*b*, the push member 31 occupies its first position of rest, the immobilizing member 49 of the end portion 42 of the flexible part 30, in this case the flexible blade, is inside the groove 23 and the free end 54 of the peripheral flange 5 is located just above the immobilizing member 49.

Figure 12A:
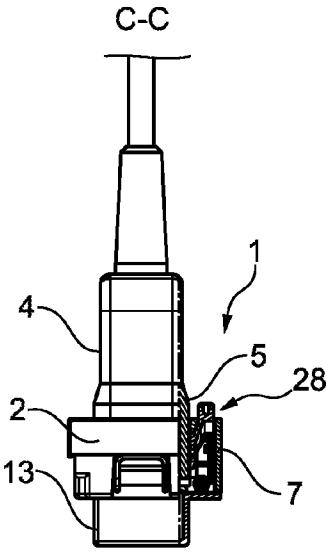
Figure 12B:
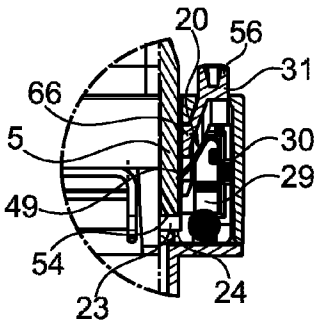
Figure 11A:
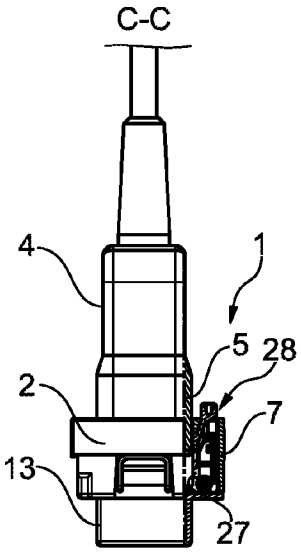
Figure 11B:
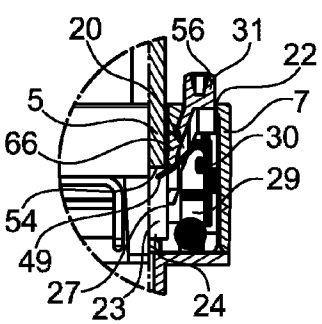
Figure 10:
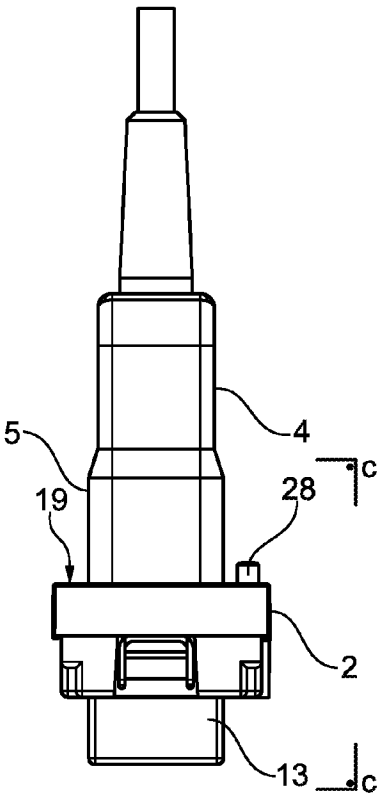
FIG. 10 represents in front view an electrical plug assembled together with an example of an electrical socket device according to the invention.

FIGS. 12*a* and 12*b* likewise illustrate a partial sectional view of the assembly, in which the electrical plug 4 is fully engaged in the electrical socket 3. In this figure, the push member 31 occupies its first position of rest, the free end 54 of the peripheral flange 5 of the electrical plug 4 is located close to the bottom 24 of the groove 23, and the immobilizing member 49 is in engagement with the peripheral flange 5 in order to retain the peripheral flange 5 in the groove 23.

Figure 13A:
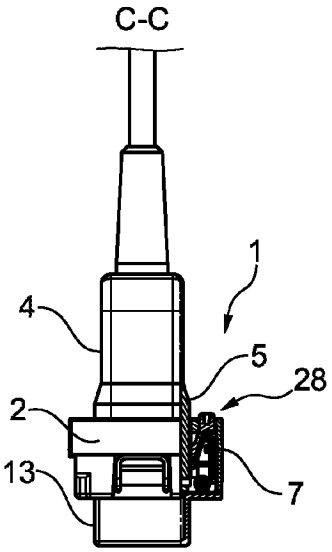
FIGS. 11*a*, 12*a*, 13*a* are partial sectional views on C-C of this electrical plug and of this device assembled in different positions.
Figure 13B:
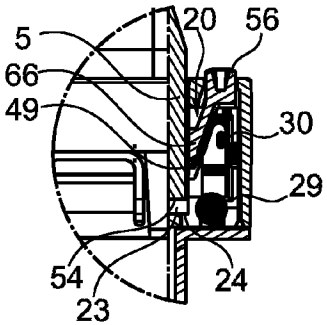
FIGS. 11*b*, 12*b*, 13*b* are views in detail of FIGS. 11*a*, 12*a*, 13*a*, illustrating different positions of the locking mechanism and of the peripheral flange of an electrical socket.

FIGS. 13*a* and 13*b* show a partial sectional view of the assembly, in which the electrical plug 4 is again engaged in the electrical socket 3. In these figures, the push member 31 occupies its second position of abutment, the free end 54 of the peripheral flange 5 of the electrical plug 5 is located close to the bottom 24 of the groove 23, and the immobilizing member 49 constrained by the actuation member 66 is retracted in the inner cavity 20 of the receptacle 2 such that the peripheral flange 5 can disengage easily, without obstacle, from the groove 23.

The mount 29 and/or the push member 31 are produced from a plastics material. Advantageously, the plastics is a polymer or a copolymer or a terpolymer. These may be chosen from the group of thermoplastic polymers comprising, for example, polyolefins, polyamides, polystyrenes, polyurethanes, polyesters, polycarbonates or, alternatively, acrylonitrile-butadiene-styrene. Preferably, this material is a polycarbonate (PC) or an acrylonitrile-butadiene-styrene (ABS). Other polymers and/or copolymers or terpolymers, preferably having properties such as non-flammability and good performance, are, of course, potentially envisaged.

Figure 15:
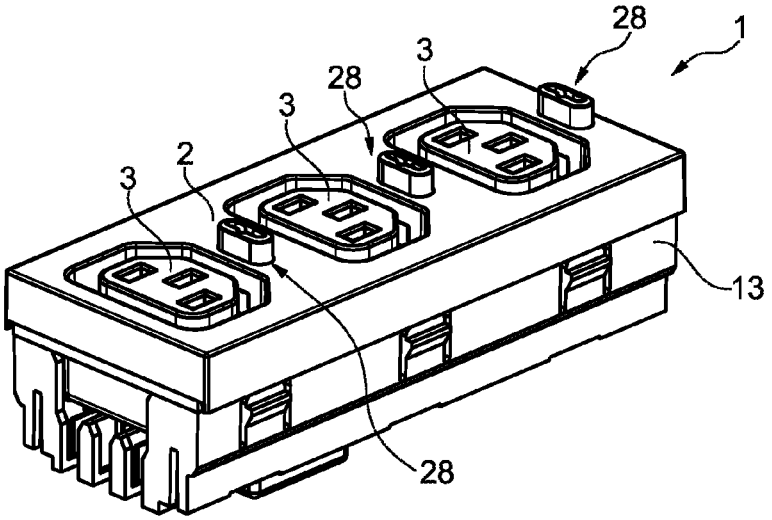
FIG. 15 represents a perspective view of an electrical socket device with a receptacle provided with a plurality of electrical sockets.

In a further embodiment of the invention, as illustrated in FIG. 15, the receptacle 2 is provided with a plurality of electrical sockets 3 designed to receive a coupling portion of an electrical plug, namely at least one peripheral flange 5. In this particular case, a plurality of mechanisms for locking and unlocking in position is likewise provided in the electrical socket device 1. In this case, the electrical socket device includes three electrical sockets 3 and three mechanisms 28 for locking and unlocking the electrical plug 4 in position, such that one of the mechanisms 28 releases the peripheral flange 5 of the electrical plug 4 that it retains and locks.

The electrical sockets 3 of the device may be couplers of type C13 and C19 interacting with electrical plugs having a peripheral flange 5.

The invention is described in the aforesaid by way of example. It is understood that a person of ordinary skill in the art is capable of implementing different variant embodiments of the invention, combining, for example, the above different features, taken alone or in combination, without thereby departing from the scope of the invention.

The invention claimed is:

1. An electrical socket device, comprising:

a receptacle provided with at least one electrical socket configured to receive a connection portion of an electrical plug, the receptacle defining at least one inner cavity and having on one of the surfaces thereof at least one through hole leading into the inner cavity, and at least one groove extending circumferentially with regard to the electrical socket, and comprising an opening leading into the inner cavity, the groove being intended to receive a peripheral flange of the electrical plug; and at least one mechanism for locking and unlocking the electrical plug in position, the locking and unlocking mechanism including:

a mount arranged in the inner cavity of the receptacle;

a flexible part mounted on the mount, said flexible part comprising an end portion extending through the opening, the end portion being provided, at the free end thereof, with a member for immobilizing the electrical plug in translation, the immobilizing member extending into the groove and being capable of retracting and of retaining, by means of bracing, the peripheral flange of the electrical plug when the peripheral flange is received in the groove; and a push member mounted on the mount, and extending through the through hole, the push member including an actuation member arranged in the inner cavity opposite the end portion of the flexible part, the push member being mounted so as to be movable in translation relative to the mount along an axis between:

a first position of rest, in which the actuation member is distant from the immobilizing member of the end portion extending into the groove, retaining the peripheral flange of the electrical plug (4) when the peripheral flange is received in the groove; and a second position of abutment on the push member, in which the actuation member bears on the end portion of the flexible part which is retracted into the inner cavity of the receptacle so as to distance the member for immobilizing the electrical plug in order to release the electrical plug, wherein the mount forms a post, the end portion of the flexible part extending forward of the post, toward the electrical socket, and in that the push member is formed from a monobloc tube capable of being engaged on the post.

2. The electrical socket device as claimed in claim 1, wherein the flexible part is configured such that, in the second position of abutment on the push member, the end portion exerts an elastic urging force on the actuation member of the push member, toward the first position of rest of the push member, giving rise to a longitudinal displacement of the push member from the second position toward the first position when the electrical plug is disengaged from the electrical socket and the groove.

3. The electrical socket device as claimed in claim 1, wherein the flexible part is a metal blade comprising a first branch extending into the inner cavity, a second branch forming the end portion, and an elbowed portion connecting the first branch to the second branch.

4. The electrical socket device as claimed in claim 3, wherein the mount is formed from two complementary half-shells defining an internal housing, the housing leading to a window, and in that the first branch and the elbowed portion are arranged in the housing of the mount, the second branch extending outside the mount, through the window.

5. The electrical socket device as claimed in claim 3, wherein the mount is formed from a monobloc part including a stud, and in that the first branch is provided with an aperture capable of receiving the stud for the clipping of the flexible blade on the mount, the flexible blade being clipped on the mount at the level of the elbowed portion.

6. The electrical socket device as claimed in claim 1, wherein the mount is provided, on an external face, with at least one reinforcement, and in that the push member includes at least one tab capable of interacting with the one or more reinforcement(s) of the mount for the clipping of the push member on the mount.

7. The electrical socket device as claimed in claim 1, wherein the monobloc tube includes a forward-projecting section, said section forming the actuation member, and in that the monobloc tube further includes a chamber provided with an opening leading under the forward-projecting section, the end portion of the flexible part extending through the opening.

8. The electrical socket device as claimed in claim 1, wherein the mount and/or the push member is constituted from a plastics material.

9. The electrical socket device as claimed in claim 1, wherein the receptacle is provided with a plurality of electrical sockets, each electrical socket being designed to receive a coupling portion of an electrical plug, and in that the electrical socket device includes a plurality of locking and unlocking mechanisms, each locking and unlocking mechanism being capable of locking and unlocking an electrical plug received in one of the electrical sockets.

* * * * *